United States Patent [19]

Sanders et al.

[11] Patent Number: 4,544,218

[45] Date of Patent: Oct. 1, 1985

[54] ELECTRICAL ORNAMENTATION SYSTEM

[75] Inventors: Robert E. Sanders, Lenexa, Kans.; Jerry L. Knipp, Grandview; Charles J. Flynn, Kansas City, both of Mo.

[73] Assignee: Hallmark Cards, Inc., Kansas City, Mo.

[21] Appl. No.: 508,522

[22] Filed: Jun. 27, 1983

[51] Int. Cl.[4] ..... H01R 29/00

[52] U.S. Cl. ..... 339/31 L; 339/157 C

[58] Field of Search ..... 339/154 R, 154 L, 155 L, 339/157 R, 157 C, 176 L, 177 L, 182 L, 184 L

[56] References Cited

U.S. PATENT DOCUMENTS

| | | | |
|---|---|---|---|
| 1,974,472 | 9/1934 | Seghers | 339/157 C |
| 3,208,032 | 9/1965 | Tilesi | 339/176 L |
| 3,214,579 | 10/1965 | Pacini | 339/157 C |
| 3,286,219 | 11/1966 | Herrick | 339/154 L |
| 3,458,849 | 7/1969 | Marks et al. | 339/28 |
| 3,609,643 | 9/1971 | Connan | 339/157 C |
| 3,617,984 | 11/1971 | Rossi | 339/176 L |
| 3,619,598 | 11/1971 | Hermanson | 339/176 L |
| 3,676,834 | 7/1972 | Kaldor et al. | 339/176 L |
| 4,114,972 | 9/1978 | Kraus et al. | 339/176 L |
| 4,298,923 | 11/1981 | Lin | 339/176 L |

*Primary Examiner*—Gil Weidenfeld
*Assistant Examiner*—David L. Pirlot
*Attorney, Agent, or Firm*—Neuman, Williams, Anderson & Olson

[57] ABSTRACT

A connector is disclosed which permits an electrically illuminated ornament or the like to be readily connected to a string of conventional light sockets. A first connection is provided which preferably is in the form of a conventional socket for receiving a lamp which is inserted in a grommet carried by an ornament. At the opposite end, contacts are mounted in a support member of insulating material to form a plug assembly arranged to fit within a conventional socket. The construction is such as to accommodate various types and dimensions of sockets.

10 Claims, 11 Drawing Figures

ELECTRICAL ORNAMENTATION SYSTEM

This invention relates to electrical ornamentation and more particularly to a system for electrical energization of ornamental elements for Christmas trees or the like. The invention permits ornaments to be readily and quickly installed and electrically connected to a string of conventional light sockets. It also facilitates mounting of an ornamental element at a desired location on a Christmas tree or other receiving structure. It additionally provides for safe and reliable operation and, at the same time, the components required are readily and economically manufacturable.

BACKGROUND OF THE INVENTION

Electrified Christmas tree ornamentation has heretofore been available in a wide variety of styles, shapes and sizes. Lights, hanging ornaments of all types and tree-top decorations have been a part of holiday decorations throughout the centuries. Typically, the lights are placed on a tree in long strands supplied from a common electrical source. The ornaments are then hung separately at random locations around the tree.

More recently, techniques have been devised for combining the functions of lights and ornaments. An early example of this are the so-called "bubble lights" which became popular in the late '40's and early '50's. Other proposals have been made for adding decoration to conventional light strings for holiday decorating purposes. The Pacini U.S. Pat. No. 3,214,579, for example, discloses a system in which a central trunk line extends up the trunk of the tree and has a plurality of outlets therein into which electrical lights may be separately plugged. These lights may or may not have additional ornamentation.

A form of lighting that has become particularly popular in recent years involves use of the so-called "miniature" lights, wherein a series of small, low voltage lights of the incandescent type are strung in series around the tree. In lighting sets of this type, the electrical supply does not lie adjacent the trunk of the tree, but rather extends around the outer tips of the branches of the tree in the same region in which the lights are resting. Accessories to enhance the appearance and illumination of these miniature lamps have been marketed in the form of stars, leaves or the like which are designed to surround a lamp to be otherwise physically connected thereto.

SUMMARY OF THE INVENTION

This invention was evolved with the general object of providing improved systems and devices for ornamentation of Christmas trees and the like.

An important aspect of the invention relates to the recognition of the problems with prior art arrangements and in the discovery of sources of such problems. One of the problems with prior art systems using conventional strings of lights is that it is difficult to physically couple the light to an ornament and at the same time position the ornament in a desired location. Usually, it is necessary to make many adjustments in the position of the string of lights and in the position of the ornament in order to obtain a reasonably satisfactory result.

With the proposed arrangements involving the use of a central trunk line or the like, there are other problems. One important problem is that such systems are expensive and are not compatible with the conventional type of system in which lights are in a string, interconnected by flexible conductors.

Another problem is that with a central trunk line arrangement, there may be a great variation in distances between the trunk line and the desired position of a light or of an ornament.

In accordance with this invention, an arrangement is provided which preserves all of the advantages of the conventional string light systems including the ready availability and relative low cost of such systems. At the same time, the arrangement of the invention permits an ornamental element or the like to be readily connected for supply of electrical current thereto and to be physically mounted in a desired location. The arrangement is very simple, involving the use of a connector which can be readily and economically manufactured.

In accordance with an important feature of the invention, a connector is provided which includes an elongated flexible cable, first connection means being provided at one end to connect to an electrically energizeable element such as a light for energizing a Christmas tree ornament. At an opposite end, second connection means are provided for connection to contacts of a conventional socket. Preferably, and in accordance with a specific feature, the second connection means includes a member of insulating material and contacts mounted thereon to form a plug assembly which fits within the hollow housing of a conventional socket.

The cable of the connector preferably includes a twisted pair of conductors with a length of on the order of six inches, for example, to provide a "pigtail" appearance. With such a "pigtail" connector, ornaments may be mounted in any desired location on the Christmas tree. At the same time, electrical connections can be readily made from a string of conventional sockets on the tree, simply by inserting the plug assembly into the closest socket, after removing a light from the closest socket, if necessary.

In accordance with another specific feature, the connection means at the ornament end of the connector may preferably comprise a socket of conventional form, arranged for receiving a conventional type of light. This arrangement is particularly advantageous in that it permits use of the connector for a wide variety of applications. When desired, a plurality of the connectors may be connected in end-to-end relation, to provide an increased length, as when the ornament to be energized is at a greater than usual distance from the nearest socket of a string.

A further feature relates to the provision of means for physically coupling the connector to the ornament, preferably by providing a resilient grommet arranged to receive a light inserted into the socket. The ornament may be supported through the connector alone or in the case of heavier ornaments, hangers or other additional support means may be employed.

Additional important features of the invention relate to the construction of the plug assembly. Preferably, the plug assembly includes a member having a reduced diameter and portion and a pair of parallel passages extending to a terminal end thereof, with a pair of elongated contacts mounted in such passages and bent back on the outside. The diameter of the end portion is preferably small enough for the end portion to be inserted into the base portion of a conventional light with the contacts extending through openings in an end wall of the conventional light to be bent back on the outside thereof. This feature is important in that it facilitates use of the connector with different sizes and configurations of sockets. To accommodate sockets designed for lamp base portions of larger sizes, the end portion of the plug member preferably is of stepped configuration with a rearward portion of larger diameter for securely fitting into the inside of a lamp base which has a larger size.

This invention contemplates other objects, features and advantages which will become more fully apparent from the following detailed description taken in conjunction with the accompanying drawings.

DESCRIPTION OF A PREFERRED EMBODIMENT

Figure 1:
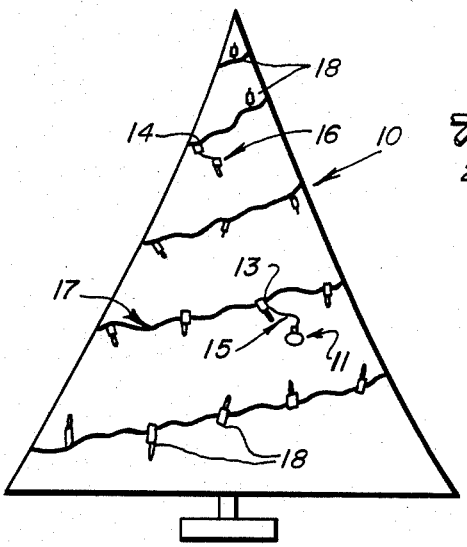
FIG. 1 diagrammatically illustrates a tree having lighted ornaments installed thereon in accordance with the invention.

Reference numeral 10, in FIG. 1 generally designates a tree having lighted ornaments 11 and 12 installed thereon, in accordance with the invention. The ornaments 11 and 12 are connected to sockets 13 and 14 through a pair of connectors 15 and 16 constructed in accordance with the invention. The sockets 13 and 14 are in a conventional string of light sockets 17, shown wrapped around the tree 10 in conventional fashion, conventional lights 18 being mounted in other sockets of the string 17.

Figure 2:
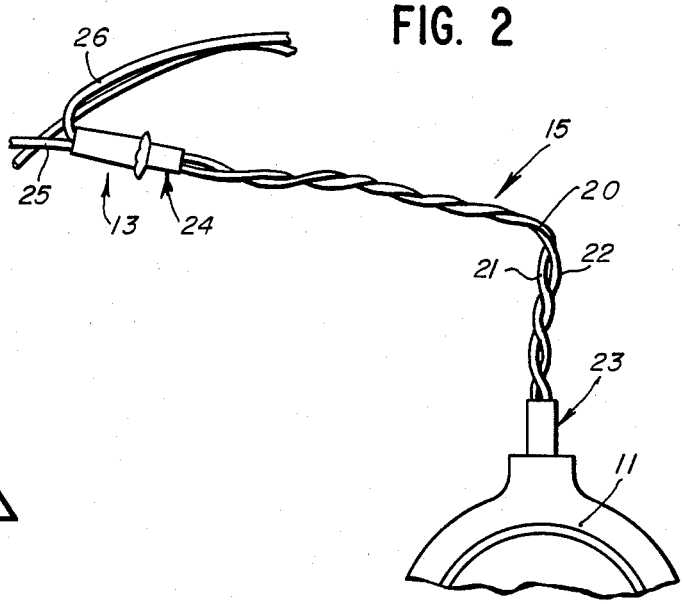
FIG. 2 illustrates the connection of one of the lighted ornaments to a string of light sockets, using a connector constructed in accordance with the invention.
Figure 3:
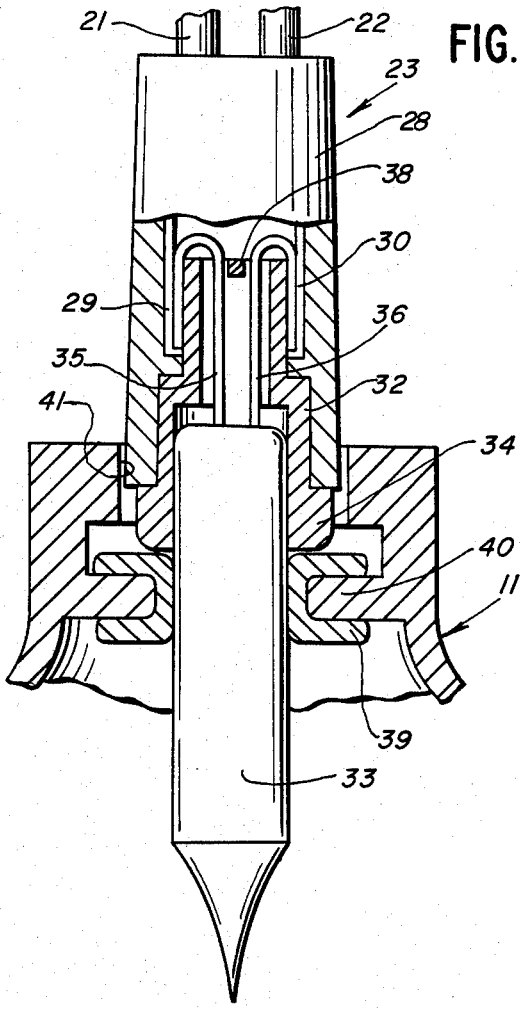
FIG. 3 is a sectional view taken substantially along line III—III of FIG. 2, illustrating the connection between the connector and the ornament.

As shown in FIG. 2, the connector 15 includes a flexible elongated cable 20 which, as shown, is formed by a twisted pair of conductors 21 and 22. A connector unit 23 is provided at one end of the cable 20 for connection to the ornament 11 and a connector unit 24 is provided at the opposite end of the cable 20 for connection to the socket 13, socket 13 being connected to conductors 25 and 26 of the light string 17.

The connector unit 23 in the illustrated embodiment has a construction like that of a conventional socket. It includes a hollow housing 28 of insulating material with a pair of contacts 29 and 30 mounted therein at diametrically opposed positions, such contacts 29 and 30 being connected to the cable conductors 21 and 22 which extend from one end of the housing 28. At the opposite end, the housing is arranged to receive a lamp base member 32 of insulating material which is hollow and which is arranged to receive an end portion of a lamp 33. The base member 32 includes a collar portion 34 which provides a shoulder arranged to abut the end of the connector housing 28. A pair of terminal wires 35 and 36 extend from the lamp and through the inner end of the base member 32. Such terminal wires 35 and 36 are bent back on the outside of the base member 32, to engage the contacts 29 and 30 when the lamp 33 together with the base member 32 are inserted into the connector housing 28. The base member 32 includes a spacer portion 38 which is disposed between the terminal wires 35 and 36 to prevent contact therebetween. In effect, the housing has an end wall with two spaced openings through which the wires 35 and 36 extend.

To connect to the ornament 11, the lamp 33 is inserted through a resilient grommet 39 which is installed in an opening in an inwardly projecting wall portion 40 of a neck portion of the ornament 11. Ornament 11 is hollow and may be transparent or translucent with suitable designs applied thereto or impressed in the material of the ornament. The terminal end of the neck portion has an opening 41 of larger size than the opening in the wall 40, with a diameter such as to limit tilting movement of the ornament 11 relative to the connector and lamp assembly. Preferably, the ornament 11 is formed in two parts which mate at a plane through the axis of the lamp and connector assembly and which are snapped together or otherwise secured together after installation of the grommet 39. The ornament 11 may, of course, include additional parts and may, for example, include front and rear lens elements which may be snapped into or otherwise secured to the aforementioned mating parts.

Figure 4:
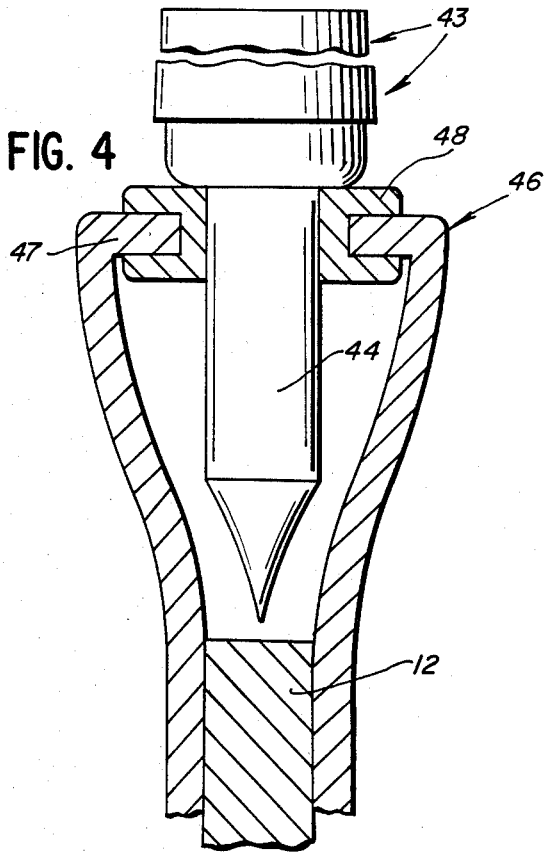
FIG. 4 is a view similar to FIG. 3 but illustrating the connection between a different type of ornament and a connector of the invention.

FIG. 4 shows the connection between the connector 16 and the ornament 12. The connector 16 is substantially identical to the connector 15 and at one end it has a connector unit which includes a socket 43 with a lamp 44 mounted therein by means of a base member 45. The ornament 12, as illustrated, is in the form of a plate which is preferably a clear transparent acrylic material, formed with a suitable design which may be etched therein with a metallic foil covering part of a back surface thereof. A generally bell-shaped metal fixture 46 is clamped onto an upper neck portion of the ornament 12 and it includes top wall portion 47 having an opening in which a resilient grommet 48 is mounted, to receive the lamp 44. The grommet 48 as well as the grommet 39 may preferably be of a polypropylene material. With the illustrated arrangement, light from the lamp 44 is projected downwardly into the transparent material of the ornament 12 to illuminate the design thereof.

Figure 5:
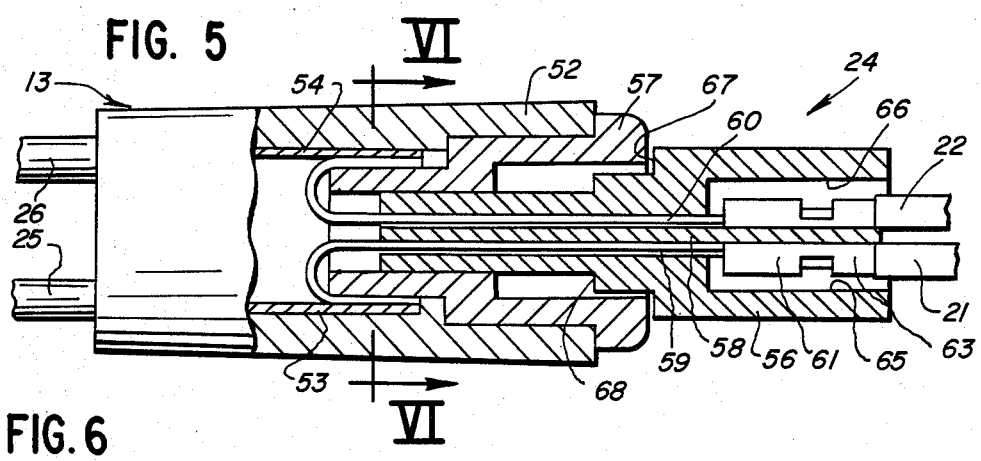
FIG. 5 is a sectional view taken substantially along line V—V of FIG. 2, illustrating the connection between the connector of the invention and a light socket.
Figure 6:
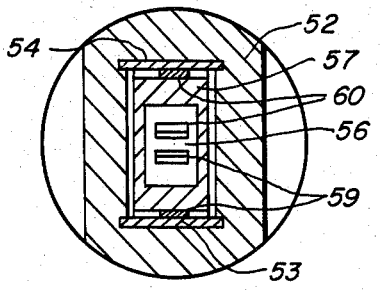
FIG. 6 is a sectional view taken substantially along line VI—VI of FIG. 5.

FIGS. 5 and 6 show the construction of the connector unit 24 and its relationship to the socket 13. The socket 13 has a conventional construction, and it includes a hollow housing 52 of insulating material with a pair of contacts 53 and 54 mounted therein at diametrically opposed positions, such contacts being connected to the conductors 25 and 26 of the string 17. The illustrated connector unit 24 includes a support member 56 of insulating material on which a base member 57 is mounted, the illustrated base member 57 having a construction like that of the lamp of base member 32 of the assembly at the opposite end of the connector 15. The support member 56 has two parallel longitudinally extending openings therethrough, separated by a wall portion 58 and arranged to receive a pair of contact blades 59 and 60. At one end, the blades 59 and 60 are secured to stripped ends of the conductors 21 and 22. At the opposite end, the blades 59 and 60 are bent back around the outside of the base member 57 for engagement with the contacts 53 and 54 of the socket 13.

Figure 7:
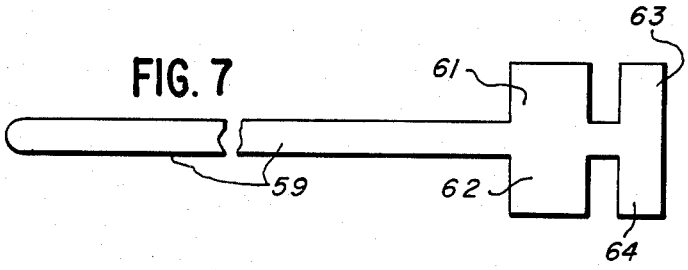
FIG. 7 is a plan view of one of two blades of the connection shown in FIGS. 5 and 6.
Figure 8:
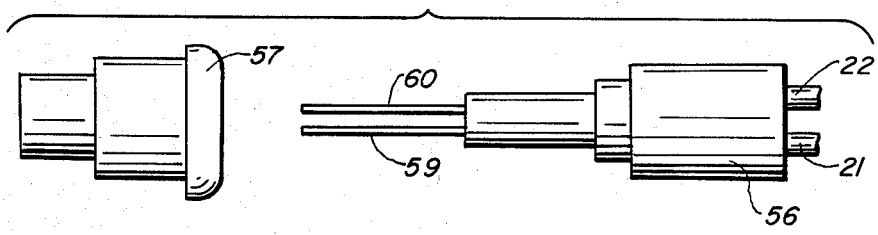
FIG. 8 is an exploded view illustrating a base member and a plug assembly of the connection shown in FIGS. 5 and 6, prior to assembly thereof.
Figure 9:
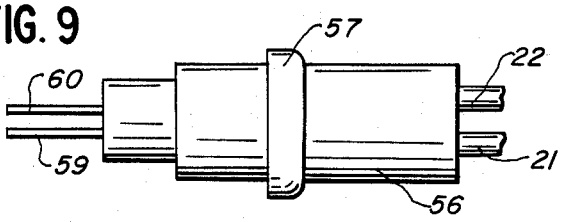
FIG. 9 is a view illustrating the components of FIG. 8 at an intermediate point in the assembly thereof.
Figure 10:
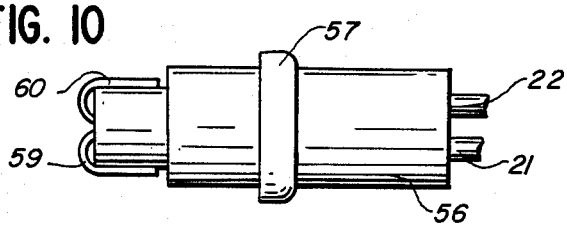
FIG. 10 illustrates the components of FIG. 8 after assembly.

FIG. 7 is a plan view of the blade 59, before assembly, it being understood that the blade 60 has the same construction. Blade 59 has a first pair of ears 61 and 62 and a second pair of ears 63 and 64 projecting transversely therefrom, arranged to be crimped around the stripped end of the conductor 21 prior to assembly. After securing both blades to the conductors 21 and 22, they may be inserted into the support member 56 with the opposite ends of the blades 59 and 60 projecting therefrom, as shown in FIG. 8. Then the assembly may be inserted into the base member 57 to cause the ends of the blades 59 and 60 to project therefrom, as shown in FIG. 9. Then the blades may be bent back around the outside of the base member 57, as shown in FIG. 10.

The end of the support member 56 which is inserted into the base member 57 has a reduced diameter to permit such insertion, the opposite end being of larger diameter to allow for larger internal spaces 65 and 66 which accommodate the connections between the blades and the conductors 25 and 26 and also to provide a shoulder 67 which may abut the end of the base member 57. Also, a stepped configuration is preferably provided with a second shoulder 68 spaced from the shoulder 67. This arrangement provides for a reasonably close fit between the support member 56 and the outer end of the base member 57. At the same time, it allows for the use of the assembly for smaller sizes of lamps.

Figure 11:
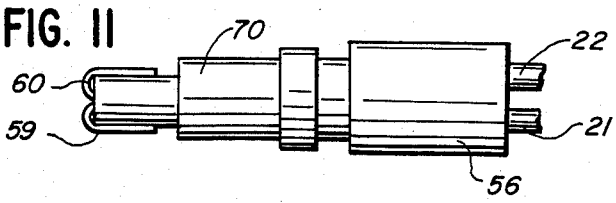
FIG. 11 illustrates an assembly of the plug assembly of the connector and a base member of smaller size than that illustrated in FIGS. 5, 6 and 8–10.

FIG. 11 shows the plug assembly of the connector unit 24 installed in a base member 70 of smaller size than that illustrated in FIGS. 5, 6 and 8–10, for use when the sockets of the string are designed for smaller types of lamps. To accommodate the vast majority of commonly used types and sizes of lamps, the terminal section of the support member 56, between the shoulder 68 and the terminal end of the member 56, preferably has a diameter of on the order of 0.15 inches and a length of on the order of 0.185 inches. The intermediate section between the shoulders 67 and 68 preferably has a diameter of on the order of 0.205 inches and a length of on the order of 0.1 inches. The blades 59 and 60 preferably have a thickness of on the order of 0.01 inches and may, for example, be of 7030 brass (soft to quarter hard).

It will be understood that modifications and variations may be effected without departing from the spirit and scope of the novel concepts of this invention.

We claim:

1. A connector for electrical connection of a lighted decorative ornament in a string of conventional sockets for miniature Christmas lights or the like, the lighted decorative element having electrical characteristics like those of a single miniature Christmas light, each of said conventional sockets including a hollow housing of insulating material having an open end with a pair of contacts within said housing arranged for engagement with contacts of a conventional miniature Christmas light and interconnected through flexible conductors with contacts of other conventional sockets of said string, said connector being arranged for connection to a selected socket of a string of conventional sockets mounted in a stationary position on a tree and said connector being arranged to provide an extension cord to obtain flexibility and mobility in the placement of a lighted decorative element on the tree with respect to said string of stationary conventional sockets, said connector comprising: an elongated flexible cable having at least two conductors, first connection means at one end of said cable for connection of said conductors thereof to said lighted decorative ornament, and second connection means at the opposite end of said elongated flexible cable for connection of said conductors thereof to contacts of a selected one of said conventional sockets, said second connection means including a member of insulating material and contact means carried by said member to form a plug assembly arranged to fit within the hollow housing of said one of said conventional sockets and to electrically connect said conductors of said cable with the contacts of said selected one of said conventional sockets, said lighted decorative element being thereby connected electrically in said string in place of a light which might otherwise be inserted in said selected one of said conventional sockets and said lighted decorative ornament being thereby movable to any desired position on said tree within the length of said flexible cable from said selected one of said stationary conventional sockets.

2. In a connector as defined in claim 1, said first connection means comprising a socket of conventional form and arranged for receiving a conventional type of light.

3. In a connector as defined in claim 2, said ornament being arranged to be illuminated by said conventional light, and said first connection means including coupling means for physically coupling one end of said cable to said ornament.

4. In a connector as defined in claim 3, said coupling means comprising a resilient grommet arranged to receive said light.

5. In a connector as defined in claim 1, said member of insulating material of said second connection means including a reduced diameter end portion having a terminal end, said member of insulating material also having a pair of parallel passages therein extending to said terminal end of said end portion, and said contact means of said second connection means including a pair of elongated contacts mounted in said passages and bent back on the outside of said reduced diameter end portion.

6. In a connector as defined in claim 5, said reduced diameter end portion being arranged to extend within the base portion of a conventional light.

7. In a connector as defined in claim 6, said pair of contacts being arranged to extend through openings in an end wall of a base portion of a conventional light and to be bent back on the outside thereof.

8. In a connector as defined in claim 7, arranged to accommodate the vast majority of commonly used types and sizes of lamps, said reduced diameter end portion being of stepped configuration and being arranged to provide sections having lengths and diameters such as to fit into base portions of the vast majority of conventional lights having different configurations and dimensions.

9. In a connector as defined in claim 8, said reduced diameter end portion including a terminal section having a diameter of on the order of 0.15 inches and a length of on the order of 0.185 inches and a larger diameter section having a diameter of on the order of 0.205 inches and a length of on the order of 0.1 inches.

10. In a connector as defined in claim 9, said first connection means comprising a socket of conventional form and arranged for receiving a conventional type of light, said ornament being arranged to be illuminated by said conventional light, and said first connection means including coupling means for physically coupling one end of said cable to said ornament.

* * * * *

US004544218B1

REEXAMINATION CERTIFICATE (2214th)

United States Patent [19]

[11] B1 4,544,218

Sanders et al.

[45] Certificate Issued Feb. 15, 1994

[54] ELECTRICAL ORNAMENTATION SYSTEM

[75] Inventors: Robert E. Sanders, Lenexa, Kans.; Jerry L. Knipp, Grandview; Charles J. Flynn, Kansas City, both of Mo.

[73] Assignee: Hallmark Cards, Inc., Kansas City, Mo.

Reexamination Request:
No. 90/002,842, Sep. 23, 1992

Reexamination Certificate for:

| | |
|---|---|
| Patent No.: | 4,544,218 |
| Issued: | Jun. 27, 1983 |
| Appl. No.: | 508,522 |
| Filed: | Oct. 1, 1985 |

[51] Int. Cl.[5] ..... H01R 17/00

[52] U.S. Cl. ..... 439/619; 439/640; 439/505

[58] Field of Search ..... 439/638–655, 439/502, 505, 506, 586, 602, 611, 619, 699, 915

[56] References Cited

U.S. PATENT DOCUMENTS

| | | | |
|---|---|---|---|
| 1,510,230 | 9/1924 | Johnston . | |
| 1,590,524 | 6/1926 | Keydel . | |
| 1,781,885 | 11/1930 | Sadacca . | |
| 1,845,638 | 2/1932 | Wermine | 439/602 |
| 2,188,529 | 1/1940 | Corina . | |
| 2,453,695 | 11/1948 | Belling . | |
| 2,533,222 | 12/1950 | Cohen . | |
| 2,542,361 | 2/1951 | Roxburgh . | |
| 2,745,078 | 5/1956 | Wood . | |
| 2,759,095 | 8/1956 | Kline . | |
| 2,769,081 | 10/1956 | Sinutko . | |
| 2,802,095 | 8/1957 | Denning et al. . | |
| 2,822,508 | 2/1958 | Rabette . | |
| 2,857,506 | 10/1958 | Minteer . | |
| 2,875,421 | 2/1959 | Jordan . | |
| 3,035,162 | 5/1962 | Emmich . | |
| 3,118,617 | 1/1964 | Hellrich . | |
| 3,118,618 | 1/1964 | Holbrook . | |
| 3,120,351 | 2/1964 | Kirsten . | |
| 3,214,579 | 10/1965 | Pacini . | |
| 3,284,696 | 11/1966 | Nagata et al. . | |
| 3,465,139 | 9/1969 | Siegal . | |
| 3,522,515 | 8/1970 | Harner . | |
| 3,603,780 | 9/1971 | Lu . | |
| 3,617,732 | 11/1971 | Fisher . | |
| 3,735,117 | 5/1973 | Hunt . | |
| 3,770,951 | 11/1973 | Corelli et al. . | |
| 3,873,880 | 3/1975 | Riddell . | |
| 3,970,834 | 7/1976 | Smith . | |
| 3,982,173 | 9/1976 | Berry et al. . | |
| 3,985,924 | 10/1976 | Pritza . | |
| 4,020,201 | 4/1977 | Miller . | |
| 4,060,722 | 11/1977 | Foley . | |
| 4,068,118 | 1/1978 | Carrington . | |
| 4,072,857 | 2/1978 | DeVicaris . | |
| 4,099,824 | 7/1978 | Schoppelrey . | |
| 4,156,892 | 5/1979 | Fisher . | |
| 4,161,768 | 7/1979 | Gauthier et al. . | |
| 4,214,296 | 7/1980 | Magett . | |
| 4,293,799 | 10/1981 | Roberts . | |
| 4,441,147 | 4/1984 | Schwarz . | |

OTHER PUBLICATIONS

Color photocopy of NOMA International, Inc., 1971 Products Catalog, p. 21.

Photographs of box and "NOMA Christmas Tree Star" by Noma.

Photographs of box and "Electric Angel Chimes" by the Keydel Co. of Detroit, Mich.

*Primary Examiner*—David Pirlot

[57] ABSTRACT

A connector is disclosed which permits an electrically illuminated ornament or the like to be readily connected to a string of conventional light sockets. A first connection is provided which preferably is in the form of a conventional socket for receiving a lamp which is inserted in a grommet carried by an ornament. At the opposite end, contacts are mounted in a support member of insulating material to form a plug assembly arranged to fit within a conventional socket. The construction is such as to accommodate various types and dimensions of sockets.

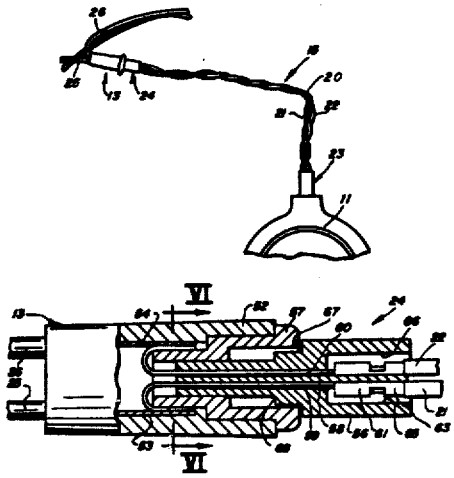

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4, 6–8 and 10 are determined to be patentable as amended.

Claims 5 and 9 dependent on an amended claim, are determined to be patentable.

New claims 11–18 are added and determined to be patentable.

1. A connector for electrical connection of a [lighted] decorative ornament in a string of conventional *miniature push-in* sockets for miniature *push-in* Christmas lights *connected in series,* or the like, [the lighted] *said ornament being capable of placement at any point on a Christmas tree and said ornament being capable of being lighted, said* decorative [element] *ornament when lighted* having electrical characteristics like those of a single miniature *push-in* Christman light, each of said conventional *miniature push-in light* sockets including a hollow housing of insulating material having an open end with a pair of contacts within said housing arranged for engagement with contacts of a conventional miniature *push-in* Christmas light and interconnected through flexible conductors with contacts of other conventional *miniature push-in light* sockets of said string, said connector being arranged for *push-in* connection to a selected socket of a string of conventional *miniature push-in light* sockets mounted in a stationary position on a tree and said connector being arranged to provide an extension cord to obtain flexibility and mobility in the placement of a [lighted] decorative [element] *ornament* on the tree with respect to said string of stationary conventional *miniature push-in light* sockets, said connector comprising: an elongated flexible cable having at least two conductors, first connection means at [one end] *a first end* of said cable for *readily insertable and removable* connection of said [conductors thereof to] *first end of said cable into* said [lighted] decorative ornament, and second connection means at the [opposite] *second* end of said elongated flexible cable for *push-in* connection of said conductors thereof to contacts of a selected one of said conventional *miniature push-in light* sockets, said second connection means including a member of insulating material [and contact means] *separately insulating and electrically isolating each of said two conductors including contact portions* carried by said member to form a *push-in* plug assembly arranged to fit within the hollow housing of said one of said conventional *miniature push-in* sockets and to electrically connect said conductors of said cable with the contacts of said selected one of said conventional *miniature push-in light* sockets, said [lighted] decorative [element] *ornament* being thereby connected electrically in said string in place of a light which might otherwise be inserted in said selected one of said conventional *miniature push-in light* sockets and said [lighted] decorative ornament being thereby movable to any desired position on said tree within the length of said flexible cable from said selected one of said stationary conventional *miniature push-in light* sockets.

2. In a connector as defined in claim 1, said first connection means comprising a *miniature push-in light* socket of conventional *push-in* form and arranged for receiving a conventional type of *miniature push-in* light.

3. In a connector as defined in claim 2, said ornament being arranged to be illuminated by said conventional *miniature push-in* light, said first connection means including coupling means for physically coupling one end of said cable to said ornament.

4. In a connector as defined in claim 3, said coupling means comprising a resilient grommet arranged to receive said *miniature push-in* light.

5. In a connector as defined in claim 1, said member of insulating material of said second connection means including a reduced diameter end portion having a terminal end, said member of insulating material also having a pair of *electrically insulating* parallel passages therein extending to said terminal end of said end portion, and said [contact means] *conductors including contact portions* of said second connection means [including a pair of elongated contacts] mounted *each separately* in said *electrically insulating parallel* passages and bent back on the outside of said reduced diameter end portion.

6. In a connector as defined in claim 5, said reduced diameter end portion being arranged to extend within the base portion of a conventional *miniature push-in* light.

7. In a connector as defined in claim 6, said pair of [contacts] *conductors including contact portions* being arranged to extend through openings in an end wall of a base portion of a conventional *miniature push-in* light and to be bent back on the outside thereof.

8. In a connector as defined in claim 7, arranged to accommodate the vast majority of commonly used types and sizes of [lamps,] *miniature push-in lights,* said reduced diameter end portion being of stepped configuration and being arranged to provide sections having lengths and diameters such as to fit into base portions of the vast majority of conventional *miniature push-in* lights having different configurations and dimensions.

10. In a connector as defined in claim 9, said first connection means comprising a *miniature push-in light* socket of conventional form and arranged for receiving a conventional type of *miniature push-in* light, said ornament being arranged to be illuminated by said conventional *miniature push-in* light, and said first connection means including coupling means for physically coupling one end of said cable to said ornament.

*11. In a connector as defined in claim 3, said coupling means comprising a resilient grommet arranged to receive said miniature light socket.*

*12. A connector for electrical connection of a decorative ornament in a string of conventional miniature sockets for miniature Christmas lights connected in series, or the like, said ornament being capable of placement at any point on a Christmas tree and said ornament being capable of being lighted, said decorative ornament when lighted having*

*electrical characteristics like those of a single miniature Christmas light, each of said conventional miniature light sockets including a hollow housing of insulating material having an open end with a pair of contacts within said housing arranged for engagement with contacts of a conventional miniature Christmas light and interconnected through flexible conductors with contacts of other conventional miniature light sockets of said string, said connector being arranged for connection to a selected socket of a string of conventional miniature light sockets mounted in a stationary position on a tree and said connector being arranged to provide an extension cord to obtain flexibility and mobility in the placement of a decorative ornament on the tree with respect to said string of stationary conventional miniature light sockets, said connector comprising: an elongated flexible cable having at least two conductors, first connection means at a first end of said cable for readily insertable and removable connection of said first end of said cable into said decorative ornament, said first connection means comprising a miniature light socket of conventional form and arranged for receiving a conventional type of miniature light, said first connection means including coupling means for physically coupling one end of said cable to said ornament, second connection means at the second end of said elongated flexible cable for connection of said conductors thereof to contacts of a selected one of said conventional miniature light sockets, said second connection means including a member of insulating material separately insulating and electrically isolating each of said two conductors including contact portions carried by said member to form a plug assembly arranged to fit within the hollow housing of said one of said conventional miniature light sockets and to electrically connect said conductors of said cable with the contacts of said selected one of said conventional miniature light sockets, said member of insulating material of said second connection means including a reduced diameter end portion having a terminal end, said member of insulating material also having a pair of electrically insulating parallel passages therein extending to said terminal end of said end portion, and said conductors including contact portions of said second connection means mounted each separately in said electrically insulating parallel passages and bent back on the outside of said reduced diameter end portion, said decorative ornament being thereby connected electrically in said string in place of a light which might otherwise be inserted in said selected one of said conventional miniature light sockets and said decorative ornament being thereby movable to any desired position on said tree within the length of said flexible cable from said selected one of said stationary conventional miniature light sockets, said ornament being arranged to be illuminated by said conventional miniature light.*

*13. In a connector as defined in claim 12, said reduced diameter end portion being arranged to extend within the base portion of a conventional miniature light.*

*14. In a connector as defined in claim 13, said pair of conductors including contact portions being arranged to extend through openings in an end wall of a base portion of a conventional miniature light and to be bent back on the outside thereof.*

*15. In a connector as defined in claim 14, arranged to accommodate the vast majority of commonly used types and sizes of miniature lights, said reduced diameter end portion being of stepped configuration and being arranged to provide sections having lengths and diameters such as to fit into base portions of the vast majority of conventional miniature lights having different configurations and dimensions.*

*16. In a connector as defined in claim 15, said reduced diameter end portion including a terminal section having a diameter of on the order of 0.15 inches and a length of on the order of 0.185 inches and a larger diameter section having a diameter of on the order of 0.205 inches and a length of on the order of 0.1 inches.*

*17. In a connector as defined in claim 16, said first connection means comprising a miniature light socket of conventional form and arranged for receiving a conventional type of miniature light, said ornament being arranged to be illuminated by said conventional miniature light, and said first connection means including coupling means for physically coupling one end of said cable to said ornament.*

*18. In a connector as defined in claim 12, said coupling means comprising a resilient grommet arranged to receive said miniature light.*

* * * * *